US006425498B1

(12) United States Patent
Gheorgheos

(10) Patent No.: US 6,425,498 B1
(45) Date of Patent: Jul. 30, 2002

(54) REMOVABLE SODA BOTTLE DISPENSER

(76) Inventor: Pavel Gheorgheos, 7510 Gray Ave., Burnaby, B.C. (CA), V5J 3Z5

( * ) Notice: Subject to any disclaimer, the term of this patent is extended or adjusted under 35 U.S.C. 154(b) by 0 days.

(21) Appl. No.: 09/732,552

(22) Filed: Dec. 8, 2000

(51) Int. Cl.[7] ..... B67D 5/06

(52) U.S. Cl. ..... 222/78; 222/132; 222/183; 222/192; 222/464.5; 251/245; 206/139

(58) Field of Search ..... 222/505, 509, 222/464.3, 464.5, 394, 78, 132, 130, 129, 183, 192, 464.1; 251/238–246; 206/139

(56) References Cited

U.S. PATENT DOCUMENTS

| | | | | | |
|---|---|---|---|---|---|
| 585,165 | A | * | 6/1897 | Stahl | 215/5 |
| 1,037,680 | A | * | 9/1912 | Spitzenberg | 215/5 |
| 1,938,174 | A | * | 12/1933 | Davis | 222/400.7 |
| 2,060,512 | A | * | 11/1936 | Magill | 222/400.8 |
| 2,739,420 | A | * | 3/1956 | Dugdale | 446/132 |
| 3,353,717 | A | * | 11/1967 | Edwards | 222/132 |
| 3,401,535 | A | * | 9/1968 | Palmer | 62/457.5 |
| 3,998,364 | A | | 12/1976 | Hollander | |
| 4,778,081 | A | | 10/1988 | Vaughan | |
| D316,208 | S | | 4/1991 | Griffiths et al. | |
| 5,022,565 | A | | 6/1991 | Sturman et al. | |
| 5,292,038 | A | | 3/1994 | Seney | |
| 5,443,186 | A | | 8/1995 | Grill | |

* cited by examiner

*Primary Examiner*—William C. Doerrler
*Assistant Examiner*—Patrick Buechner

(57) ABSTRACT

A dispensing assembly for a beverage container is provided including a carbonated beverage container containing a carbonated beverage. A dispenser includes a body assembly screwably mounted on the carbonated beverage container with a dispenser spout extending therefrom. A tube depends from the dispenser into the container and remains in communication with the dispenser spout. Situated within a bore formed in the body assembly is a plunger. Such bore connects the tube and the dispensing spout. The plunger has a spring urging the same into a first orientation for preventing the flow of fluid from the tube to the dispensing spout. Also included is a lever connected to the plunger for urging the plunger into a second orientation for allowing the flow of fluid from the tube to the dispensing spout.

8 Claims, 2 Drawing Sheets

REMOVABLE SODA BOTTLE DISPENSER

BACKGROUND OF THE INVENTION

1. Field of the Invention

The present invention relates to soda dispensers and more particularly pertains to a new removable soda bottle dispenser for dispensing soda from a beverage container and further maintaining the same fresh between use.

2. Description of the Prior Art

The use of soda dispensers is known in the prior art. More specifically, soda dispensers heretofore devised and utilized are known to consist basically of familiar, expected and obvious structural configurations, notwithstanding the myriad of designs encompassed by the crowded prior art which have been developed for the fulfillment of countless objectives and requirements.

Known prior art soda dispensers include U.S. Pat. No. 3,998,364; U.S. Pat. No. 5,292,038; U.S. Pat. No. 4,778,081; U.S. Pat. No. 5,022,565; U.S. Pat. Des. 316,208; and U.S. Pat. No. 5,443,186.

In these respects, the removable soda bottle dispenser according to the present invention substantially departs from the conventional concepts and designs of the prior art, and in so doing provides an apparatus primarily developed for the purpose of dispensing soda from a beverage container and further maintaining the same fresh between use.

SUMMARY OF THE INVENTION

In view of the foregoing disadvantages inherent in the known types of soda dispensers now present in the prior art, the present invention provides a new removable soda bottle dispenser construction wherein the same can be utilized for dispensing soda from a beverage container and further maintaining the same fresh between use.

The general purpose of the present invention, which will be described subsequently in greater detail, is to provide a new removable soda bottle dispenser apparatus and method which has many of the advantages of the soda dispensers mentioned heretofore and many novel features that result in a new removable soda bottle dispenser which is not anticipated, rendered obvious, suggested, or even implied by any of the prior art soda dispensers, either alone or in any combination thereof.

To attain this, the present invention generally comprises a portable soft drink dispenser for fastening to a standard carbonated beverage container and providing a convenient dispensing of the contents while maintaining the carbonation of the beverage until fully consumed. The dispenser is comprised of a body assembly for threadedly engaging the conventional carbonated beverage container such as one or two liter PET containers. The body assembly contains a telescopic tube for connecting the bottom end of the container to a dispenser outlet of the body assembly. A spring-loaded valve mechanism is included for obturating the tube. Dispensing is manually operable for controllably allowing the flow of the beverage through the dispensing tube by pressing on two levers in an elephant ears shape.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the. designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new removable soda bottle dispenser apparatus and method which has many of the advantages of the soda dispensers mentioned heretofore and many novel features that result in a new removable soda bottle dispenser which is not anticipated, rendered obvious, suggested, or even implied by any of the prior art soda dispensers, either alone or in any combination thereof.

It is another object of the present invention to provide a new removable soda bottle dispenser which may be easily and efficiently manufactured and marketed.

It is a further object of the present invention to provide a new removable soda bottle dispenser which is of a durable and reliable construction.

An even further object of the present invention is to provide a new removable soda bottle dispenser which is susceptible of a low cost of manufacture with regard to both materials and labor, and which accordingly is then susceptible of low prices of sale to the consuming public, thereby making such removable soda bottle dispenser economically available to the buying public.

Still yet another object of the present invention is to provide a new removable soda bottle dispenser which provides in the apparatuses and methods of the prior art some of the advantages thereof, while simultaneously overcoming some of the disadvantages normally associated therewith.

Still another object of the present invention is to provide a new removable soda bottle dispenser for dispensing soda from a beverage container and further maintaining the same fresh between uses.

Even still another object of the present invention is to provide a new removable soda bottle dispenser that for a beverage container including a carbonated beverage container containing a carbonated beverage. The dispenser includes a body assembly screwably mounted on the carbonated beverage container with a dispenser spout extending therefrom. A tube depends from the dispenser into the container and remains in communication with the dispenser spout. Situated within a bore formed in the body assembly is a plunger. Such bore connects the tube and the dispensing spout. The plunger has a spring urging the same into a first orientation for preventing the flow of fluid from the tube to the dispensing spout. Also included is a lever connected to the plunger for urging the plunger into a second orientation for allowing the flow of fluid from the tube to the dispensing spout.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
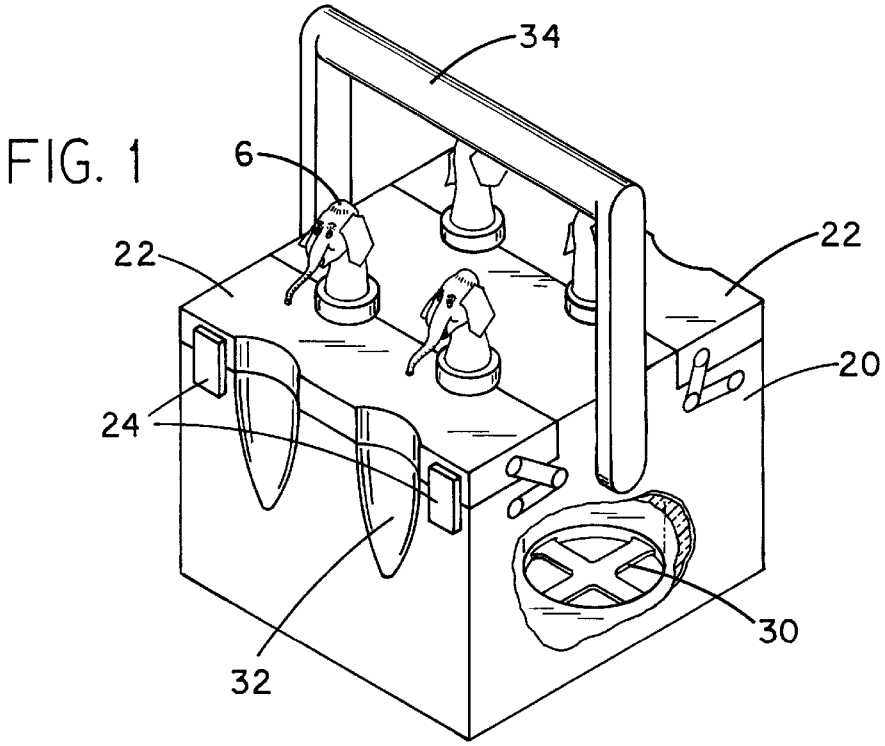
FIG. 1 is a perspective view of a new removable soda bottle dispenser according to the present invention.

With reference now to the drawings, and in particular to FIGS. 1 through 6 thereof, a new removable soda bottle dispenser embodying the principles and concepts of the present invention will be described.

The dispenser of the present invention is generally characterized by a body assembly 6 having a lower portion which screws directly onto a top of a soft drink bottle 14. The body assembly further has a forward mid portion forming a dispensing spout 7 in an elephant trunk shape. Two dispensing levers 10 are included for controllably dispensing the soft drink through the dispensing spout. The dispensing levers 10 consist of a light metal core covered with plastic or rubber in an elephant ears shape.

Dispensing valve body assembly 6 is preferably molded of a tough synthetic plastic material and may take the form of a characterization of an animal's head, for example an elephant's head, as illustrated. Also coupled to the body assembly 6 is a flexible, telescopic tube 12 which reaches into bottle 14 to a position adjacent to the bottom thereof so as to allow the operation of the dispenser with the bottle in an upright position. The tube preferably has a bellowed portion for affording the flexible nature of the tube. The flexible discharge tube 12 extends up to the body assembly 6, which provides a connection through a calibrated orifice to the dispensing spout 7. As an option, the spout may be constructed from an elastomeric material which has a flexibility that is a greater than a material from which the remaining body assembly is constructed.

Figure 6:
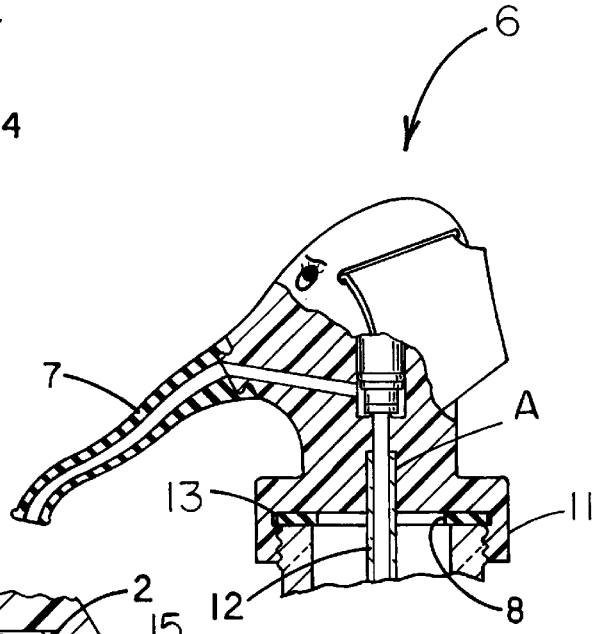
FIG. 6 is a second side cross-sectional view of the body assembly of the present invention.
Figure 5:
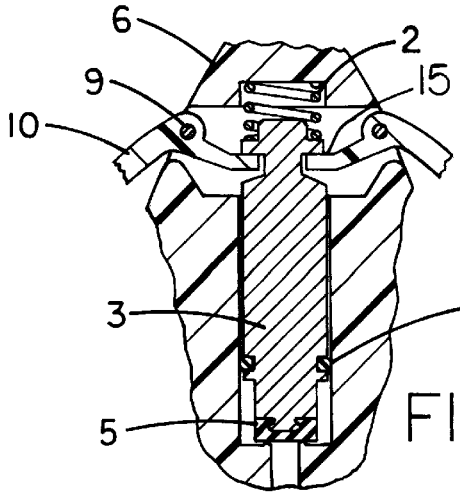
FIG. 5 is a first side cross-sectional view of the body assembly of the present invention.

As illustrated in FIGS. 5 & 6 which are each a cross section of the dispenser only, a valve plunger mechanism 3 is movable in a cylindrical opening or bore in the body assembly 6. The dispensing spout communicates with a bottom of the aforementioned opening or bore. as shown in FIG. 6. The valve plunger mechanism comprises a cylindrical plunger rod with a protrusion formed on a top thereof. The plunger rod yieldingly collapses the flow by obturating the bottom of the opening or bore with a rubber fitting washer 5 that is capable of being inserted within the orifice. A lower end of a compressing spring 2 encompasses the protrusion on the plunger rod and provides the obturating force.

When dispensing levers 10 are actioned, the plunger 3 is moved upwards by pushing in shoulders 15 which are defined by an annular recess formed in the plunger rod. The depression of the levers open the connection between the tube 12 and dispensing spout 7 through the orifice by disengaging the fitting washer from the bottom of the central bore or opening of the body assembly. The plunger rod 3 of the dispensing mechanism will preferably be molded of a tough synthetic plastic material and further be encompassed by an o-ring 4 which sealingly abuts an inner periphery of the central bore or opening. The axis of symmetry is the same for the spring 2, valve 3, tube 12, and bottle 14.

Means is provided for sealingly securing the dispensing valve upon the externally threaded neck of an ordinary large-size carbonated beverage bottle 14. To this end, the screw cap portion 11 of the body member 6 is internally threaded, as indicated. The inner end of the internally-threaded portion of dispenser extends into a short, concentric, cylindrical opening 13 of slightly increased diameter to define with the inner end of the threaded portion a narrow, circumferential shoulder. Snugly fitted within the cylindrical opening 13 and retained in place by the peripheral shoulder is a resilient washer 8. The minimum diameter of a central opening in the washer 8. when said washer is in an unstressed condition within its cylindrical opening, is equal to the external diameter of discharge tube 12 so as to adjustably receive said tube for passage therethrough upon assembly of the device.

When the screw cap portion 11 of the dispensing valve is screwed down upon the neck of the bottle 14, the resilient washer 8, which will probably be of natural or synthetic rubber, will become axially squeezed against the annular bottom of the cylindrical opening 13, so as to distort principally inwardly in radial directions as to circumferentially clamp about the fluid discharge tube at its peripheral zone. Thus, it will be understood that not only is the upper end or mouth of the bottle neck peripherally sealed with respect to the underside of the resilient washer 8, but the central washer opening will also seal against the flexible discharge tube 12, immediately behind its entrance in the passageway A—in the body member 6, thereby preventing any leakage of gas or fluid from the bottle into said passageways and the associated valve mechanism, or outwardly of the bottle through the outer end of the valve body member screw cap portion. through sealing o-ring.

Figure 2:
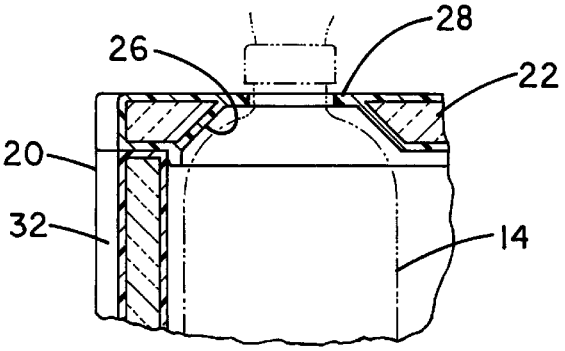
FIG. 2 is a side cross-sectional view of the cooler of the present, invention.
Figure 3:
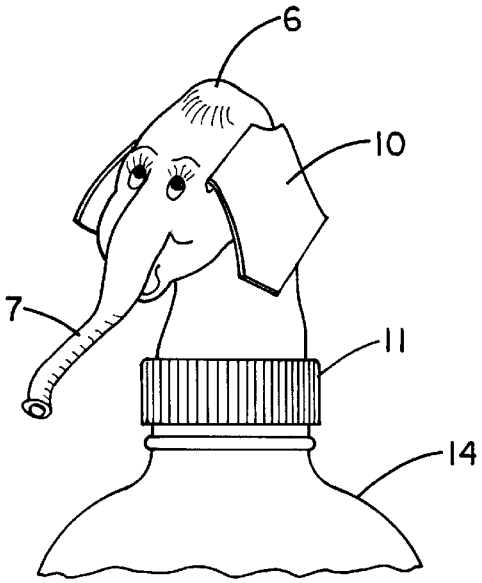
FIG. 3 is a front exterior view of the body assembly of the present invention.
Figure 4:
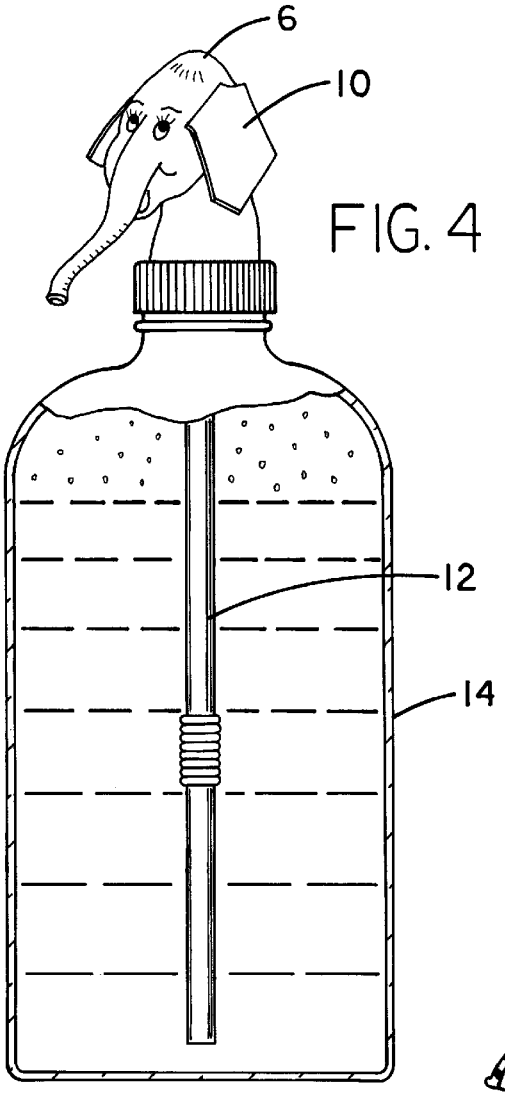
FIG. 4, is a side cross-sectional view of the present invention.

As an option, a cooler 20 may be provided, as shown in FIGS. 1 & 2. Such cooler is defined by a bottom face with a peripheral side wall coupled to the bottom face and extending upwardly therefrom to define an interior space and an open top. Detachable lids 22 are preferably included with a pair of spring-loaded latches 24 mounted on opposed side edges thereof for releasable engaging notches formed in the peripheral side wall of the cooler.

As best shown in FIG. 2, the lid and each face of the cooler is constructed from an insulated material. In use, the cooler is preferably filled with ice or the like. The lid further has a plurality of frusto-conical recesses 26 formed in a lower surface thereof which terminate with an aperture 28 formed in the upper surface of the lid. By this structure, a plurality of the aforementioned bottles may be positioned within the cooler with the necks thereof extending from the apertures of the lid for allowing the body assemblies to be attached thereto, wherein the body assemblies remain exterior of the cooler.

As an option, recesses 30 may be formed in an upper surface of the bottom face of the cooler for receiving bottoms of the bottles. Such recesses each preferably have a raised periphery and a recessed center. The bottom of the bottles are thereby prevented from shifting. As yet another option, a pair of parallel cylindrical indentations 32 may be formed in opposed side faces of the cooler and the lid. Such indentations allow a cup that is to be filled to be positioned closer to the dispensing spout. For carrying purposes, an inverted U-shaped handle 34 has a pair of lower ends pivotally coupled to opposed side faces of the cooler.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A dispensing assembly for a beverage container comprising, in combination:

a carbonated beverage container containing a carbonated beverage;

a dispenser including a body assembly having a lower portion which screws directly onto a top of the container, a forward mid portion forming a dispensing spout in an elephant trunk shape, two dispensing levers for controllably dispensing the beverage from the spout with the dispensing levers being constructed of a light metal core covered with an elastomeric material in elephant ears shape, a flexible telescopic tube reaching into the container and extending up to the body assembly for connection with an orifice which is connected to the dispensing spout, a valve plunger mechanism movable in a cylindrical opening above the orifice and controllable by way of the dispenser levers for selectively obturating the orifice with a rubber fitting washer, a compressing spring for urging the valve plunger mechanism downward in sealing abutment with the orifice to preclude the flow of fluid to the dispensing spout, wherein an axis of symmetry is the same for the spring, the valve plunger mechanism, the tube, and the container;

said body assembly of the dispenser further including a screw cap portion which is internally threaded with an inner end extending into a short, concentric, cylindrical opening of slightly increased diameter that defines a narrow, circumferential shoulder, wherein a resilient washer is snugly fitted within the cylindrical opening and retained in place by the shoulder, the resilient washer having a central opening with a minimum diameter equal to an external diameter of the discharge tube; and a cooler having a lid with a plurality of apertures formed therein for passing a neck of a plurality of the containers when the containers are positioned in the cooler, wherein a plurality of the dispenser assemblies are mounted on the necks of the containers and reside on top of the lid.

2. A dispensing assembly for a beverage container comprising:

a carbonated beverage container containing a carbonated beverage;

a dispenser including a body assembly screwably mounted on the carbonated beverage container;

a dispenser spout extending from the body assembly;

a tube depending from the dispenser into the container, the tube remaining in communication with the dispenser spout;

a plunger slidably situated within a bore formed in the body assembly, the bore connecting the tube and the dispensing spout, the plunger having a spring urging the same into a first orientation for preventing the flow of fluid from the tube to the dispensing spout;

a lever connected to the plunger for urging the plunger into a second orientation for allowing the flow of fluid from the tube to the dispensing spout; and a cooler having a lid with a plurality of apertures formed therein for passing a neck of a plurality of the containers when the containers are positioned in the cooler, wherein a plurality of the dispenser assemblies are mounted on the necks of the containers and reside on top of the lid.

3. A dispensing assembly as set forth in claim 2 wherein the body assembly takes on an animal shape and a pair of levers are mounted on the body assembly in the shape of appendages.

4. A dispensing assembly as set forth in claim 2 and further including a washer situated between the body assembly and an upper peripheral edge of a neck of the container, wherein a central opening of the washer has a diameter equal to an external diameter of the tube and is further adapted to compress the tube upon the coupling of the dispenser on the beverage container.

5. A dispensing assembly as set forth in claim 2 wherein the plunger has an o-ring mounted about a periphery thereof for sealingly abutting a periphery of the bore of the body assembly.

6. A dispensing assembly as set forth in claim 2 wherein the plunger has an elastomeric piece mounted on a bottom thereof for sealing a bottom of the bore of the body assembly.

7. A dispensing assembly as set forth in claim 2 wherein the tube has a telescoping length.

8. A dispensing assembly as set forth in claim 2 wherein the plunger, tube spring remain in axial alignment.

* * * * *